US012241631B2

(12) United States Patent
Farrel et al.

(10) Patent No.: US 12,241,631 B2
(45) Date of Patent: Mar. 4, 2025

(54) OVEN HANDLE LOCATORS FOR CONTROLLING DOOR APPEARANCE

(71) Applicant: Haier US Appliance Solutions, Inc., Wilmington, DE (US)

(72) Inventors: Caleb Farrel, Jeffersonville, IN (US); Evan Wade Kessick, Portage, MI (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 425 days.

(21) Appl. No.: 17/591,733

(22) Filed: Feb. 3, 2022

(65) Prior Publication Data

US 2023/0243512 A1 Aug. 3, 2023

(51) Int. Cl.
*F24C 15/04* (2006.01)
*F24C 15/02* (2006.01)

(52) U.S. Cl.
CPC ..... *F24C 15/024* (2013.01); *F24C 15/04* (2013.01)

(58) Field of Classification Search
CPC ..... F24C 15/024; F24C 15/04
See application file for complete search history.

(56) References Cited

U.S. PATENT DOCUMENTS 4,638,529 A 1/1987 Katona
5,819,722 A 10/1998 Katz
D763,654 S 8/2016 Chung et al.
D851,989 S 6/2019 Funnell, II et al.
2023/0288074 A1* 9/2023 Miranda ..... F24C 15/08
2024/0151405 A1* 5/2024 Farrel ..... F24C 15/024

FOREIGN PATENT DOCUMENTS

DE 3644021 A1 6/1988
KR 100643332 B1 11/2006
KR 20070025772 A 3/2007

* cited by examiner

*Primary Examiner* — Alfred Basichas
(74) *Attorney, Agent, or Firm* — Dority & Manning, P.A.

(57) ABSTRACT

An oven appliance includes a cabinet defining a cooking chamber to receive items to be cooked. The oven appliance includes a door that rotates between an open and closed position. The oven appliance further includes a door handle including two ends, each end of the door handle including two locator pin. The door handle attaches to a door trim, wherein the outer locator pin on one end of the door handle sets the horizontal and vertical alignment of the door trim and the outer locator pin on the opposite end of the door handle sets the angular alignment of the door trim. The door handle also attaches to a first handle bracket and a second handle bracket. The outer and inner locating pins on one end of the door handle set the vertical and horizontal alignment and the angular alignment of the first handle bracket, respectively. The outer and inner locating pins on the opposite end of the door handle set the vertical and horizontal alignment and the angular alignment of the second handle bracket, respectively.

20 Claims, 8 Drawing Sheets

OVEN HANDLE LOCATORS FOR CONTROLLING DOOR APPEARANCE

FIELD OF THE INVENTION

The present subject matter relates generally to oven appliances, and more particularly to locating pint for attaching and aligning an oven door handle, trim, and handle bracket to an oven door.

BACKGROUND OF THE INVENTION

Conventional residential and commercial oven appliances generally include a cabinet that defines a cooking chamber for receipt of food items for cooking. A door is attached to the cabinet, rotating between an open and closed position. When the door is in the closed position, an unsightly gap exists between the top of oven door and the bottom of the cooktop or control panel, depending on the arrangement of the oven.

Some conventional oven appliance include a decorative door trim to obscure the gaps along the front and sides of the oven. However, it is often difficult to align and control the critical appearance elements of the oven appliance, including the parallelism of the trim, door handle, and oven cooktop/control panel and the centering of the trim and door handle on the front of the oven. Where the door handle extends substantially the full width of the oven door, it is also difficult to ensure that the door handle is flush with the side of the oven door. Even where parallelism, centering, and flushness are achieved, conventional ovens require significant effort in assembly to achieve these attributes.

Accordingly, oven appliances having a mechanism to quickly and accurately set the relative position of the door handle, door trim, and oven door would be desirable.

BRIEF DESCRIPTION OF THE INVENTION

Aspects and advantages of the invention will be set forth in part in the following description, or may be obvious from the description, or may be learned through practice of the invention.

In one aspect of the present disclosure, an oven appliance is provided. The oven appliance includes a cabinet to receive items to be cooked, a door pivotably attached to the cabinet, a first handle bracket attached to the door, a second handle bracket attached to the door, a door trim, and a door handle. The door may pivot between an open position and a closed position for selectively accessing the cooking chamber. The first handle bracket may include an outer opening and an inner opening. The second handle bracket may include an outer opening and an inner opening. The door trim may include a first end and a second end, the first end of the door trim including an outer opening and an inner opening and the second end of the door trim including an outer opening and an inner opening. The door handle may include a first end and a second end, the first end of the door handle having a first outer locating pin and a first inner locating pin and the second end of the door handle having a second outer locating pin and a second inner locating pin. The first outer locating pin extends through the outer opening of the first end of the door trim and the outer opening of the first handle bracket. The first inner locating pin extends through the inner opening of the first end of the door trim and the inner opening of the first handle bracket. The second inner locating pin extends through the inner opening of the second end of the door trim and the inner opening of the second handle bracket. The second outer locating pin extends through the outer opening of the second end of the door trim and the outer opening of the second handle bracket.

In another aspect of the present disclosure, an oven appliance is provided. The oven appliance includes cabinet defining a cooking chamber to receive items to be cooked, a door pivotably attached to the cabinet, a first handle bracket attached to the door, a second handle bracket attached to the door, a door trim, a door handle, a first outer locating pin, a first inner locating pin, a second inner locating pin, and a second outer locating pin. The door may pivot between an open position and a closed position for selectively accessing the cooking chamber. The door trim may include a first end and a second end, the first end of the door trim comprising an outer opening and an inner opening and the second end of the door trim comprising an outer opening and an inner opening. The door handle may include a first end and a second end. The first outer locating pin extends through the outer opening of the first end of the door trim and connects to the first end of the door handle, the first end of the door trim, and the first handle bracket. The first inner locating pin extends through the inner opening of the first end of the door trim and connects to the first end of the door handle, the first end of the door trim, the first handle bracket. The second inner locating extends through the inner opening of the second end of the door trim and connects to the second end of the door handle, the second end of the door trim, and the second handle bracket. The second outer locating pin extends through the outer opening of the second end of the door trim and connects to the second end of the door handle, the second end of the door trim, and the second handle bracket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
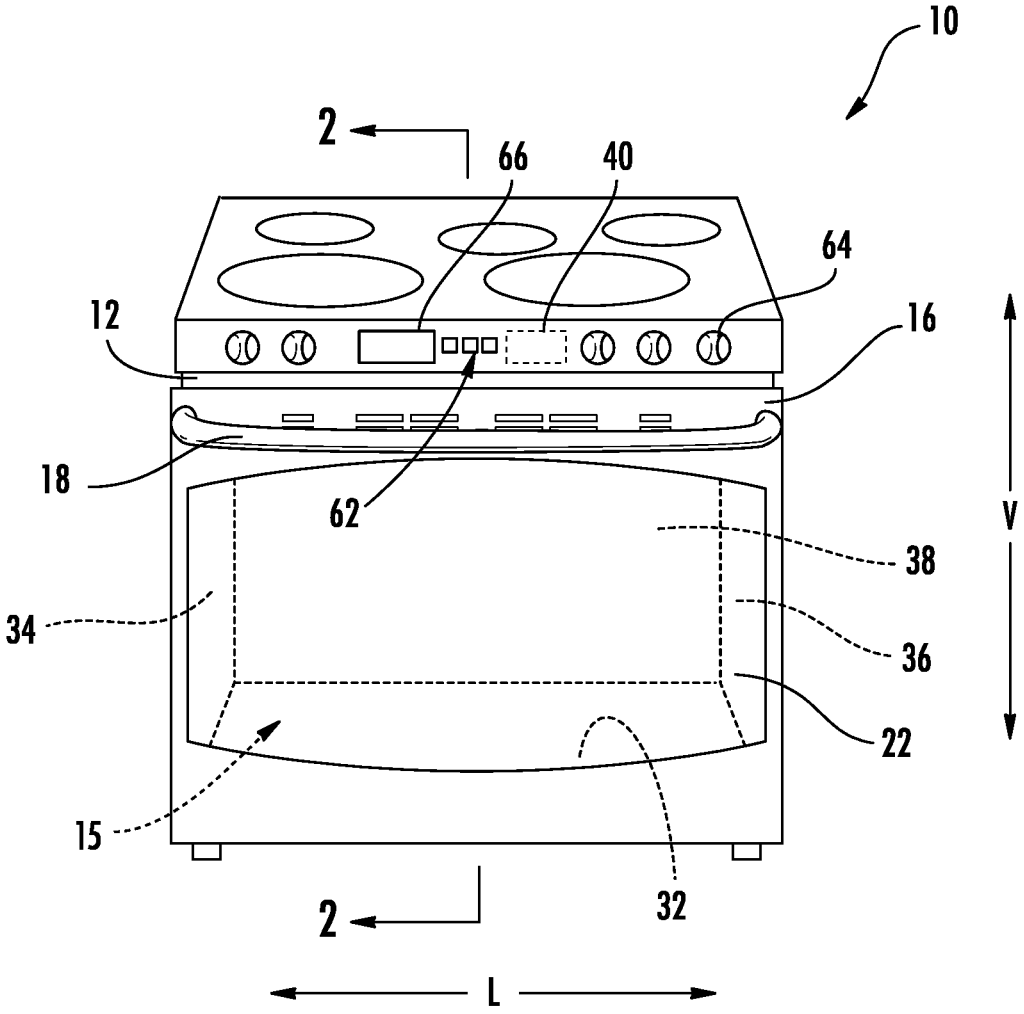
FIG. 1 provides a front perspective view of an oven appliance according to one or more example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise. The terms "upstream" and "downstream" refer to the relative direction with respect to fluid flow in a fluid pathway. For example, "upstream" refers to the direction from which the fluid flows, and "downstream" refers to the direction to which the fluid flows.

Figure 2:
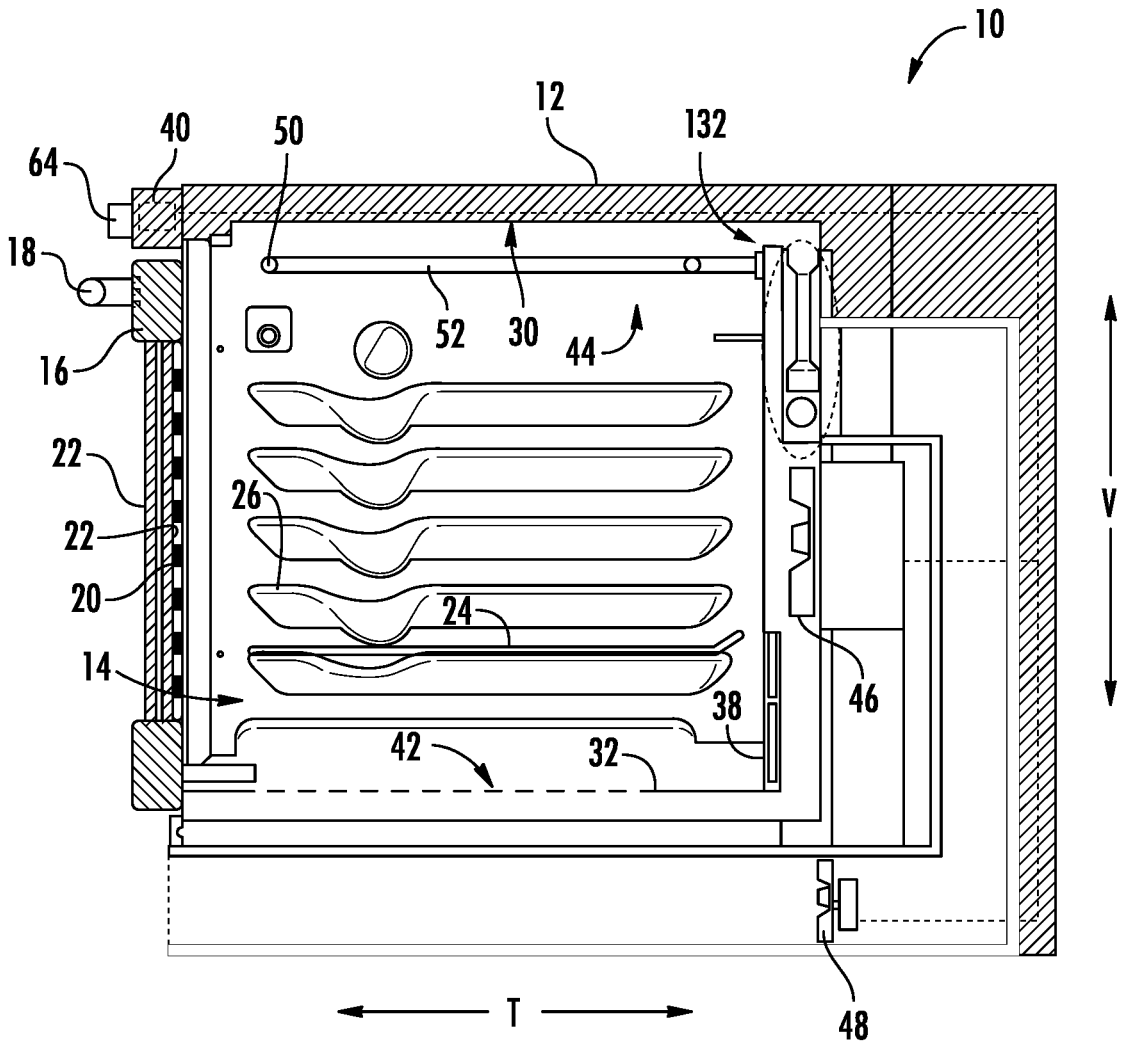
FIG. 2 provides a cross-sectional side view of the exemplary oven appliance of FIG. 1 taken along the line 2-2 of FIG. 1.
Figure 3:
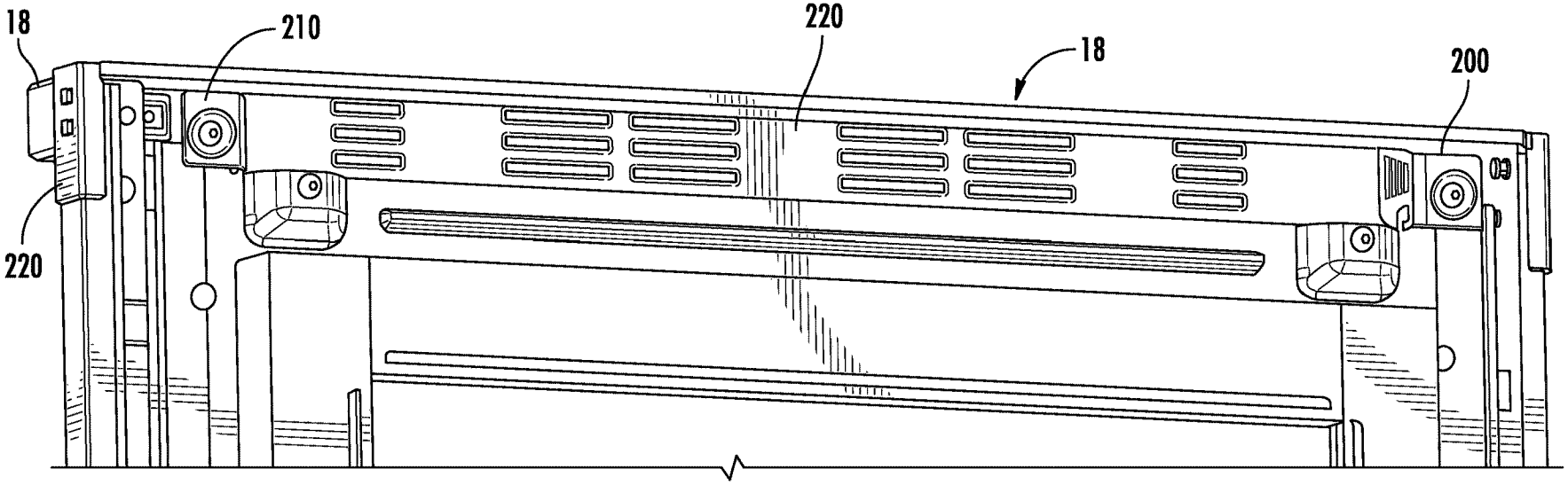
FIG. 3 provides a perspective view of a portion of an oven door according to one or more exemplary embodiment of the present disclosure.

Turning now to the figures, FIGS. 1 through 3 provide views of an example oven appliance which may incorporate embodiments of the present subject matter. For instance, FIG. 1 provides a perspective view of an oven appliance 10 according to example embodiments of the present subject matter. FIG. 2 provides a section view of oven appliance 10 taken along the 2-2 line of FIG. 1. FIG. 3 provides a front view of oven appliance 10 with a door 16 omitted. Oven appliance 10 defines a vertical direction V, a lateral direction L, and a transverse direction T. The vertical direction V, lateral direction L, and transverse direction T are mutually perpendicular and form an orthogonal direction system. As will be understood, oven appliance 10 is provided by way of example only, and the present subject matter may be used in any suitable oven appliance. For example, the oven appliance may be a wall oven or a freestanding range that also includes a cooktop, as illustrated. As another example, the oven appliance may include multiple interior cavities that define multiple heating chambers in the oven appliance. Thus, the present subject matter may be used with other oven or range appliance configurations, e.g., that define multiple interior cavities for the receipt of food and/or having different configuration than what is shown in FIG. 2.

Oven appliance 10 includes an insulated cabinet 12 with an interior cooking chamber 14 defined by an interior surface 15 of cabinet 12. Cooking chamber 14 is configured for the receipt of one or more food items to be cooked. Oven appliance 10 includes a door 16 rotatably mounted to cabinet 12, e.g., with a hinge (not shown). A door handle 18 is mounted to door 16 and assists a user with opening and closing door 16 in order to access opening 20 to cooking chamber 14. For example, a user can pull on handle 18 to open or close door 16 and access cooking chamber 14 through front opening 20.

Multiple parallel glass panes 22 provide for viewing the contents of cooking chamber 14 when door 16 is closed and assist with insulating cooking chamber 14. A baking rack 24 is positioned in cooking chamber 14 for the receipt of food items or utensils containing food items. Baking rack 24 is slidably received onto embossed ribs 26 or sliding rails such that rack 24 may be conveniently moved into and out of cooking chamber 14 when door 16 is open.

As shown, various walls define the cooking chamber 14. For example, cooking chamber 14 includes a top wall 30 and a bottom wall 32 which are spaced apart along the vertical direction V. Left sidewall 34 and right sidewall 36 (as defined according to a perspective front view as shown in FIG. 1, e.g., from the perspective of a user facing the oven appliance 10 to access/use the oven appliance 10 and/or cooking chamber 14) extend between the top wall 30 and bottom wall 32, and are spaced apart along the lateral direction L. A rear wall 38 additionally extends between the top wall 30 and bottom wall 32 as well as between the left sidewall 34 and right sidewall 36, and is spaced apart from the door 16 along the transverse direction T. Cooking chamber 14 is thus defined between the top wall 30, bottom wall 32, left sidewall 34, right sidewall 36, and rear wall 38.

Optionally, a lower heating assembly 42 may be included in oven appliance 10, e.g., for baking operations within cooking chamber 14. Lower heating assembly 42 may include a discrete heating element (not pictured) which is disposed within the cooking chamber 14, such as adjacent to the bottom wall 32. In some embodiments, the lower heating assembly 42 includes a gas burner. Additional components, such as an igniter and a fuel line may be provided in some such embodiments. Alternatively, the lower heating assembly 42 may include an electric heating element or may be any other suitable bake assembly having any other suitable heating element.

An upper heating assembly, such as a broiler assembly 44, may be included in oven appliance 10. Broiler assembly 44 includes a convection heating element 50 and a radiant heating element 52. The radiant heating element 52 may be an electric heating element, such as a resistive heating rod as illustrated in FIG. 2. The convection components of broiler assembly 44 include one or more air handlers 46, 48, e.g., fans or blowers, and a convection heating element 50. As illustrated, convection heating element 50 is generally positioned away from cooking chamber 14 such that convection heat (and not radiation heat) is received in cooking chamber 14 from convection heating element 50. Convection heating element 50 may be an electric heating element, such as a resistive heating rod, or a gas burner configured to generate a heated gas for cooking operations. Air handler(s) 46, 48 may be in fluid communication with convection heating element 50 to motivate heated gas from the convection heating element 50 and through a broil outlet 132 into the cooking chamber 14. Broil outlet 132 may be provided at or proximate to a top portion of the cooking chamber 14, e.g., at the top wall 30, such as at or proximate to an intersection of the top wall 30 with the rear wall 38. Moreover, during certain operations, broil outlet 132 may be downstream from air handler(s) 46, 48 and convection heating element 50 to receive a heated gas therefrom.

Advantageously, the heating elements 50 and 52 may employ different heat sources, e.g., the convection heating element 50 may be a gas burner and the radiant heating element 52 may be an electric heating element, such that the combined system, e.g., broiler assembly 44, provides advantages over broilers using a single energy source, such as only electric or only combustion. In such embodiments, the radiant heating element 52 may be a low-power heating element. Thus, the combined broiler assembly 44 may provide improved heat intensity as compared to a purely radiant or purely convective broil system. By bathing the electric element 52 in the hot air or exhaust from the convective heating element 50, the relatively low powered (e.g., about 1500 W) electric element 52 can achieve temperatures that will allow it to radiate substantial energy to food items in the cooking chamber, and together with the convective heat element 52 gives superior broil results.

Oven appliance 10 may further include a controller 40, e.g., configured to control one or more operations of the oven appliance 10. For example, controller 40 may control at least one operation of oven appliance 10 that includes broiler assembly 44. Controller 40 may be in communication (via for example a suitable wired or wireless connection) with the heating elements 50 and 52 as well as other suitable components of the oven appliance 10, as discussed herein. In general, controller 40 may be operable to configure the oven appliance 10 (and various components thereof) for cooking. Such configuration may be based, for instance, on a plurality of cooking factors of a selected operating cycle or mode.

By way of example, controller 40 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 40 may be positioned in a variety of locations throughout oven appliance 10. As illustrated, controller 40 may be located within a user interface panel 62 of oven appliance 10 as shown in FIGS. 1 and 2. In some such embodiments, input/output ("I/O") signals may be routed between controller 40 and various operational components of oven appliance 10, such as convection heating element 50, radiant heating element 52, air handler(s) 46, 48, controls 64, display component 66, sensors, alarms, and/or other components as may be provided. For instance, signals may be directed along one or more wiring harnesses that may be routed through cabinet 12. In some embodiments, controller 40 is in communication with user interface panel 62 and controls 64 through which a user may select various operational features and modes and monitor progress of oven appliance 10. In one embodiment, user interface panel 62 may represent a general purpose I/O ("GPIO") device or functional block. In one embodiment, user interface panel 62 may include input components, such as one or more of a variety of electrical, mechanical or electro-mechanical input devices including rotary dials, push buttons, and touch pads. User interface panel 62 may include a display component 66, such as a digital or analog display configured to provide operational feedback to a user.

Although the described embodiment of FIGS. 1 and 2 are directed to an oven appliance 10 in which the user interface panel 62 and controls 64 are aligned with the top of cabinet 12, it should be recognized that the present disclosure is not so limited. For example, alternative oven appliance designs may also fall within the scope of the present disclosure, for example, wherein the user interface panel and controls are located behind and above the cooktop or wherein more, fewer, and different types and/or arrangements of heating elements are present.

Figure 4:
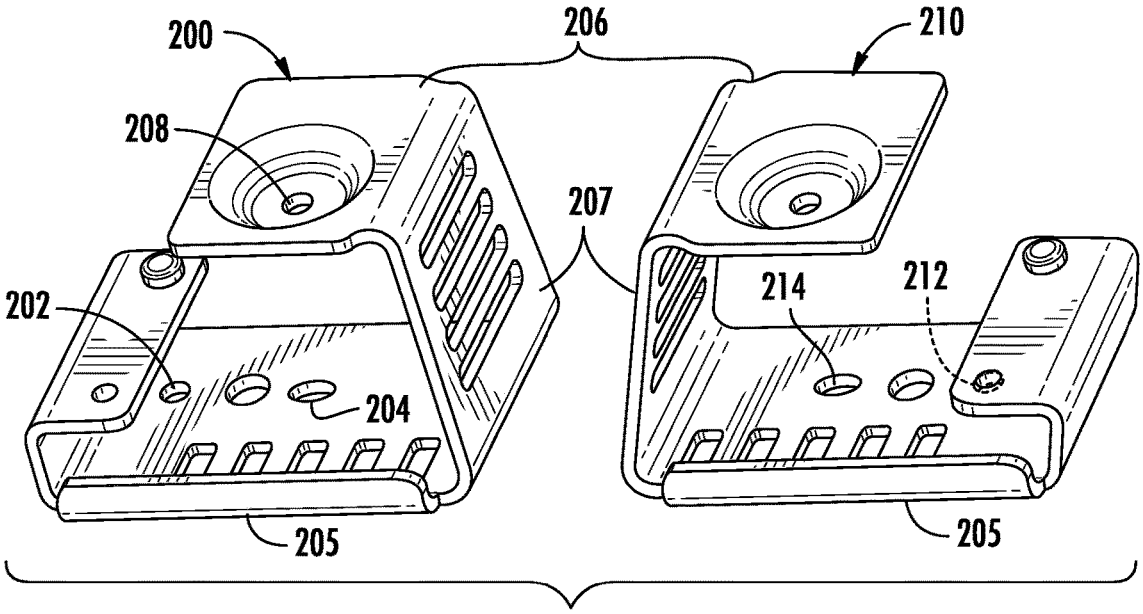
FIG. 4 provides a front perspective view of a handle bracket according to one or more exemplary embodiments of present disclosure.

Referring now to FIG. 4, a rear perspective view of an exemplary first handle bracket 200 and an exemplary second handle bracket 210 is provided. First handle bracket 200 and second handle bracket 210 are mirror images of one another but are in all other respects identical. First handle bracket 200 and second handle bracket 210 include a first plate 205 and second plate 206. First plate 205 and second plate 206 are substantially parallel to one another and spaced apart in the transverse direction. First plate 205 in nearer to the front side of the door 16, whereas second plate 206 is nearer to the rear side of the door 16. Each of first handle bracket 200 and second handle bracket 210 also includes connector plate 207, which is oriented primarily in the transverse direction, connecting first plate 205 to second plate 206.

Second plate 206 further includes an embossed connecting element 208, such as a bolt hole, screw hole, rivet hole, or the like. Using the embossed connecting element 208, first handle bracket 200 and second handle bracket 210 are attached to the door 16. Specifically, bolts, screws, rivets, or other appropriate connection means are inserted into a rear surface of door 18 and through the embossed connecting element 208 of first handle bracket 200 and the embossed connections element 208 of second handle bracket 210, thus securing the door 16 to first handle bracket 200 and second handle bracket 210, respectively (FIG. 3).

In the embodiment of FIG. 4, the first plate 205 of the first bracket handle 200 includes an outer opening 202 and an inner opening 204 for accommodating locator pins, as further described herein. Likewise, in the embodiment of FIG. 4, the first plate 205 of the second bracket handle 210 includes an outer opening 212 and an inner opening 214 for accommodating locator pins, as further described herein.

The combination of the first plate 205, the second plate 206, and the connector plate 207 of first handle bracket 200 and second handle bracket 210 establish a consistent, fixed depth in the transverse direction. As a result, connection of a door trim 220 and door handle 18 to the first handle bracket 200 and the second handle bracket 210, as further discussed herein, provides a consistent, accurate, and repeatable spacing of the door trim 220 and the door handle 18 in the transverse direction with respect to the oven door 16.

Figure 5:
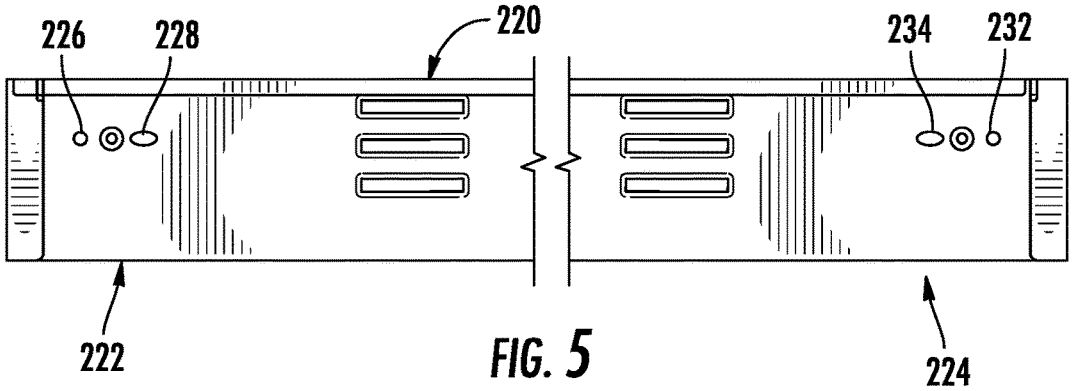
FIG. 5 provides a front view of a door trim according to one or more exemplary embodiments of present disclosure.

Referring now to FIG. 5, a front view of the door trim 220 is provided. The door trim 220 is a critical appearance element of oven appliance 10, providing an aesthetic cover for at least partially concealing gaps between the oven door 16 and the cabinet 12, and specifically, gaps above the oven and around a portion of the side of cabinet 12. In some oven appliances, such as shown in the embodiment of FIG. 1, the gap is between oven door 16 and, for example, user interface panel 62 and controls 64. In other embodiments of oven appliance 10, user interface panel 62 and controls 64 may be located elsewhere, such as behind the cooktop on the top surface of cabinet 12. In such instances, the gap concealed by door trim 220 may be between the top of oven door 16 and the cooktop on the top surface of cabinet 12.

Door trim 200 may include a first end 222 and a second end 224. Door trim 200 comprises a vertical rectangular surface extending primarily in the lateral direction, a panel on the first end of door trim 200 extending primarily in the direction of the cabinet 12, and a panel on the second end of door trim 200 extending primarily in the direction of cabinet 12 (see FIG. 3). The first end 222 of door trim 200 may further include an outer opening 226 and an inner opening 228 for accommodating locator pins, as further described herein. The second end 224 of door trim 200 may further include an outer opening 232 and an inner opening 234 for accommodating locator pins, as further described herein.

Figure 6:
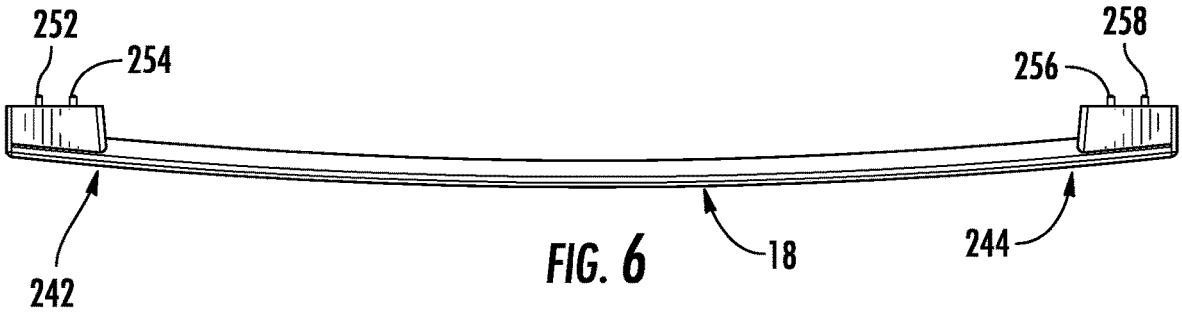
FIG. 6 provides a top view of a door handle according to one or more exemplary embodiments of present disclosure.

Referring now to FIG. 6, a top view of an exemplary door handle 18 is provided. Door handle 18 may include a first end 242 and a second end 244. In the embodiment of FIG. 6, the first end 242 of door handle 18 may include a first outer locating pin 252 and a first inner locating pin 254, both extending from door handle 18 in the direction of cabinet 12. The first outer locating pin 252 and the first inner locating pin 254 may be spaced apart from each other in the horizontal or lateral direction. Alternatively, or additionally, in some embodiments first outer locating pin 252 and first inner locating pin 254 may be spaced apart in the vertical direction. Likewise, in the embodiment of FIG. 6, the second end 244 of door handle 18 may include a second inner locating pin 256 and a second outer locating pin 258, both extending from door handle 18 in the direction of cabinet 12. The second outer locating pin 258 and the second inner locating pin 256 may be spaced apart from each other in the horizontal or lateral direction. Alternatively, or additionally, in some embodiments second outer locating pin 258 and second inner locating pin 2546 may be spaced apart in the vertical direction.

Figure 7A:
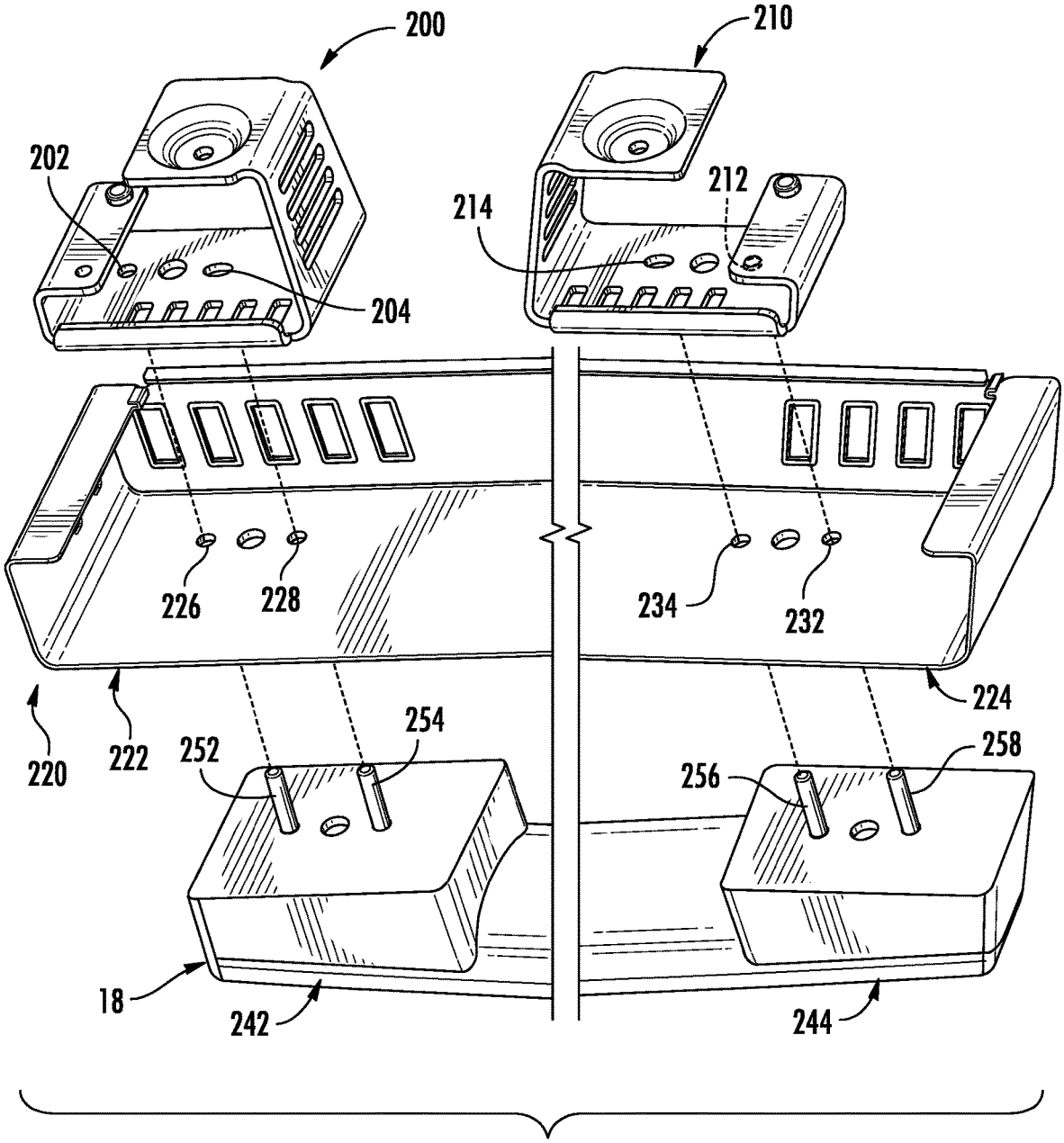
FIG. 7A provides a perspective view of the relationship between a door handle, door trim, and handle bracket according to one or more exemplary embodiments of present disclosure.

FIG. 7A provides a perspective view of the relationship between the door handle 18, the door trim 220, and each of the first handle bracket 200 and the second handle bracket 210 according to their exemplary embodiments as shown in FIGS. 4-6. In this embodiment, the first outer locating pin 252 extends from the door handle 18 and through the outer opening 226 of the first end 222 of the door trim 220. The first outer locating pin 252 further extends through the outer opening 202 of the first handle bracket 200.

In addition, the first inner locating pin 254 extends from the door handle 18 and through the inner opening 228 of the first end 222 of the door trim 220. The first inner locating pin 254 also extends through the inner opening 204 of the first handle bracket 200. In this embodiment, the inner opening 204 of the first handle bracket 200 may be a slot, having a substantially oval-shaped opening to ease install of first inner locating pin 254.

Furthermore, in this embodiment, the second inner locating pin 256 extends from the door handle 18 and through the inner opening 234 of the second end 224 of the door trim 220. The second inner locating pin 256 also extends through the inner opening 214 of the second handle bracket 210. In this embodiment, the inner opening 214 of the second handle bracket 210 may be a slot, having a substantially oval-shaped opening to ease installation of second inner locating pin 256.

Finally, the second outer locating pin 258 extends from the door handle 18 and through the outer opening 232 of the second end 224 of the door trim 220. The second outer locating pin 258 also extends through the outer opening 212 of the second handle bracket 210. In this embodiment, the outer opening 232 of the second end 224 of the door trim 220 may be a slot, having a substantially oval-shaped opening to ease installation of second outer locator 258.

In the embodiment of FIG. 7A, the extension of the first outer locating pin 252 through the outer opening 226 of the first end 222 of the door trim 220 fixes the horizontal and vertical position of the door trim 220, ensuring a consistent location of door trim 220 on the front face of oven appliance 10. Similarly, the extension of second outer locating pin 258 through the outer opening 232 of the second end 224 of door trim 220 fixes the angular position of door trim 220, providing the ability to ensure that installation of door trim 220 consistently achieves parallelism with door handle 18 and the top of oven door 16. Inner opening 228 on the first end 222 of door trim 220 and inner opening 234 on the second end 224 of door trim 220 serve as clearance holes to allow for passage of first inner locating pin 254 and second inner locating pin 256, respectively.

Referring still to the embodiment of FIG. 7A, the extension of first outer locating pin 252 through the outer opening 202 of first handle bracket 200 fixes the horizontal and vertical position of the first handle bracket 200, ensuring consistent location of first handle bracket 200 for alignment with the connecting means through oven door 16. Similarly, the extension of first inner locating pin 254 through the inner opening 204 of first handle bracket 200 fixes the angular position of first handle bracket 200, providing the ability to ensure that installation of the first handle bracket 200 consistently aligns embossed connection element 208 with the corresponding opening for the connection means through oven door 16. Additionally, the extension of second outer locating pin 258 through the outer opening 212 of second handle bracket 210 fixes the horizontal and vertical position of the second handle bracket 210, ensuring consistent location of second handle bracket 210 for alignment with the connecting means through oven door 16. Similarly, the extension of second inner locating pin 256 through the inner opening 214 of second handle bracket 210 fixes the angular position of second handle bracket 210, providing the ability to ensure that installation of the second handle bracket 210 consistently aligns embossed connection element 208 with the corresponding opening for the connection means through oven door 16.

Although the preferred embodiment is set forth above and illustrated in FIG. 7A, one of ordinary skill in the art will recognize that the first outer locating pin 252, the first inner locating pin 254, the second inner locating pin 256, and the second outer locating pin 258 need not extend from the door handle 18 to fall with the intended scope of the present disclosure. Rather, some or all of the locating pins may extend from the first handle bracket 200 and the second handle bracket 210, extending through corresponding holes in the door handle 18, some combinations of which are set forth below.

However, in each of these embodiments: (1) the first outer locating pin 252 extends through the outer opening 226 of the first end 222 of the door trim 220 and connects to the first end 242 of the door handle 18, the first end 222 of the door trim 220, and the first handle bracket 200; (2) the first inner locating pin 254 extends through the inner opening 228 of the first end 222 of the door trim 220 and connects to the first end 242 of the door handle 18, the first end 222 of the door trim 220, and the first handle bracket 200; (3) the second inner locating pin 256 extends through the inner opening 234 of the second end 224 of the door trim 220 and connects to the second end 244 of the door handle 18, the second end 224 of the door trim 220, and the second handle bracket 210; and (4) the second outer locating pin 258 extends through the outer opening 232 on the second end 224 of the door trim 220 and connects to the second end 244 of the door handle 18, the second end 224 of the door trim, and the second handle bracket 210. Additionally, in each of these embodiments, the extension of the first outer locating pin 252 through the outer opening 226 of the first end 222 of the door trim 220 fixes the horizontal and vertical position of the door trim 220, as previously mentioned. Further, the extension of the second outer locating pin 258 through the outer opening 232 of the second end 224 of the door trim 220 fixes the angular position of the door trim 220.

Figure 7B:
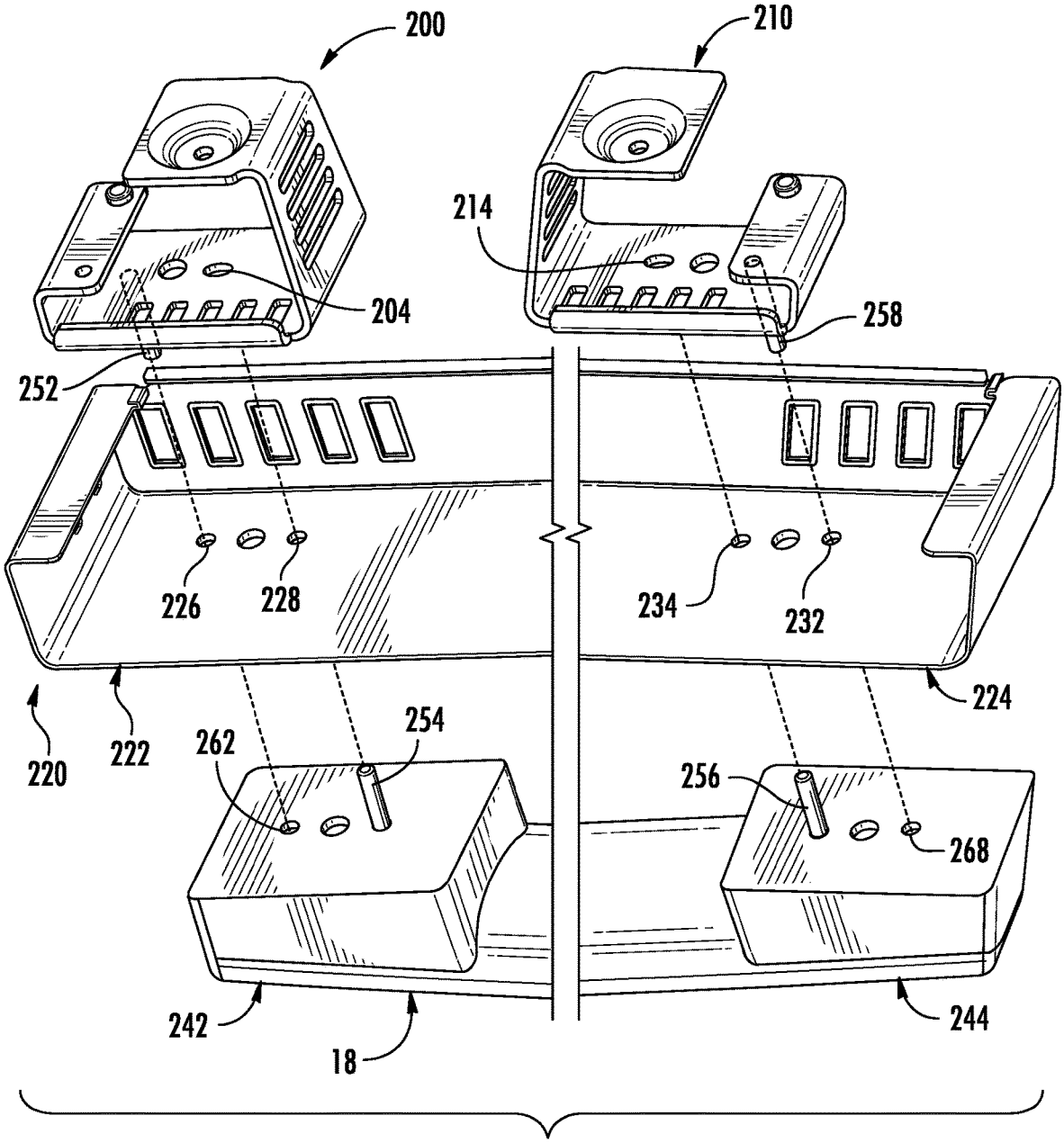
FIG. 7B provides a perspective view of the relationship between a door handle, door trim, and handle bracket according to one or more exemplary embodiments of present disclosure.

One such alternative embodiment is shown in FIG. 7B. In this embodiment, the first outer locating pin 252 is attached to and extends from the first handle bracket 200, extending through an outer opening 262 on the first end 242 of the door handle 18. The first inner locating pin 254 is attached to and extends from the first end 242 of the door handle 18, extending through the inner opening 204 of the first handle bracket 200. The second inner locating pin 256 is attached to and extends from the second end 244 of the door handle 18, extending through an inner opening 214 on the second handle bracket 210. And the second outer locating pin 258 is attached to and extends from the second handle bracket 210, extending through an outer opening 268 on the second end 244 of the door handle 18.

In the embodiment of FIG. 7B, the extension of the first outer locating pin 252 through the outer opening 262 of the first end 242 of the door handle 18 fixes the horizontal and vertical position of the first handle bracket 200, ensuring consistent location of first handle bracket 200 for alignment with the connecting means through oven door 16. Similarly, the extension of the first inner locating pin 254 through the inner opening 204 of the first handle bracket 200 fixes the angular position of the first handle bracket 200, providing the ability to ensure that installation of the first handle bracket 200 consistently aligns embossed connection element 208 with the corresponding opening for the connection means through oven door 16.

Furthermore, the extension of the second outer locating pin 258 through the outer opening 268 of the second end 244 of the door handle 18 fixes the horizontal and vertical position of the second handle bracket 210, ensuring consistent location of second handle bracket 210 for alignment with the connecting means through oven door 16. Similarly, the extension of the second inner locating pin 256 through the inner opening 214 of the second handle bracket 210 fixes the angular position of the second handle bracket 210, providing the ability to ensure that installation of the second handle bracket 210 consistently aligns embossed connection element 208 with the corresponding opening for the connection means through oven door 16.

Figure 7C:
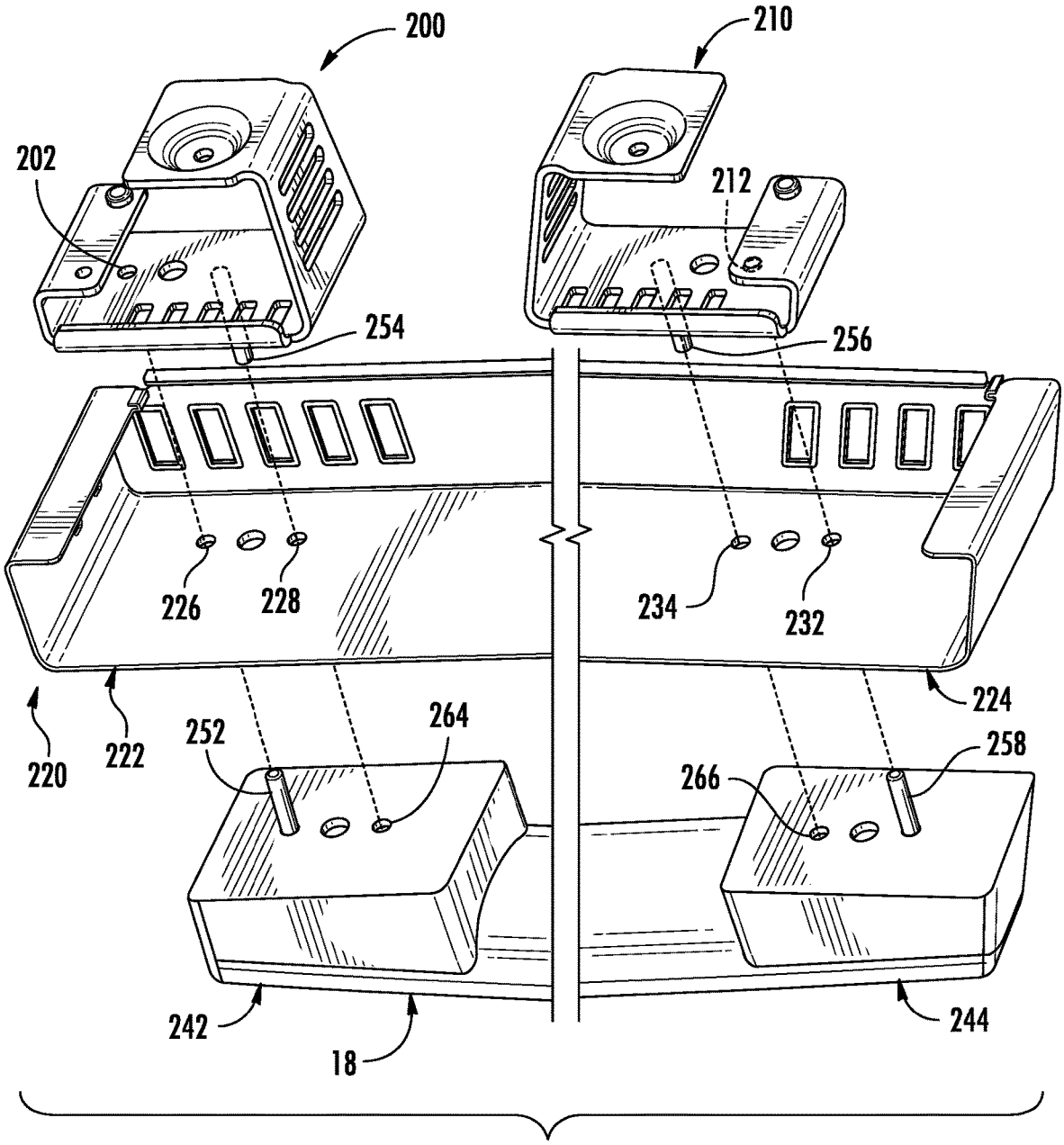
FIG. 7C provides a perspective view of the relationship between a door handle, door trim, and handle bracket according to one or more exemplary embodiments of present disclosure.

FIG. 7C provides another alternative embodiment. In this embodiment, the first outer locating pin 252 is attached to and extends from the first end 242 of the door handle 18, extending through an outer opening 202 of the first handle bracket 200. The first inner locating pin 254 is attached to and extends from the first handle bracket 200, extending through the inner opening 264 of the first end 242 of the door handle 18. The second inner locating pin 256 is attached to and extends from the second handle bracket 210, extending through an inner opening 266 of the second end 244 of the door handle 18. And the second outer locating pin 258 is attached to and extends from the second end 244 of the door handle 18, extending through an outer opening 212 on the second handle bracket 210.

In the embodiment of FIG. 7C, the extension of the first outer locating pin 252 through the outer opening 202 of the first handle bracket 200 fixes the horizontal and vertical position of the first handle bracket 200, ensuring consistent location of first handle bracket 200 for alignment with the connecting means through oven door 16. Similarly, the extension of the first inner locating pin 254 through the inner opening 264 of the first end 242 of the door handle 18 fixes the angular position of the first handle bracket 200, providing the ability to ensure that installation of the first handle bracket 200 consistently aligns embossed connection element 208 with the corresponding opening for the connection means through oven door 16.

Furthermore, the extension of the second outer locating pin 258 through the outer opening 212 of the second handle bracket 210 fixes the horizontal and vertical position of the second handle bracket 210, ensuring consistent location of second handle bracket 210 for alignment with the connecting means through oven door 16. Similarly, the extension of the second inner locating pin 256 through the inner opening 266 of the second end 244 of the door handle 18 fixes the angular position of the second handle bracket 210, providing the ability to ensure that installation of the second handle bracket 210 consistently aligns embossed connection element 208 with the corresponding opening for the connection means through oven door 16.

Figure 7D:
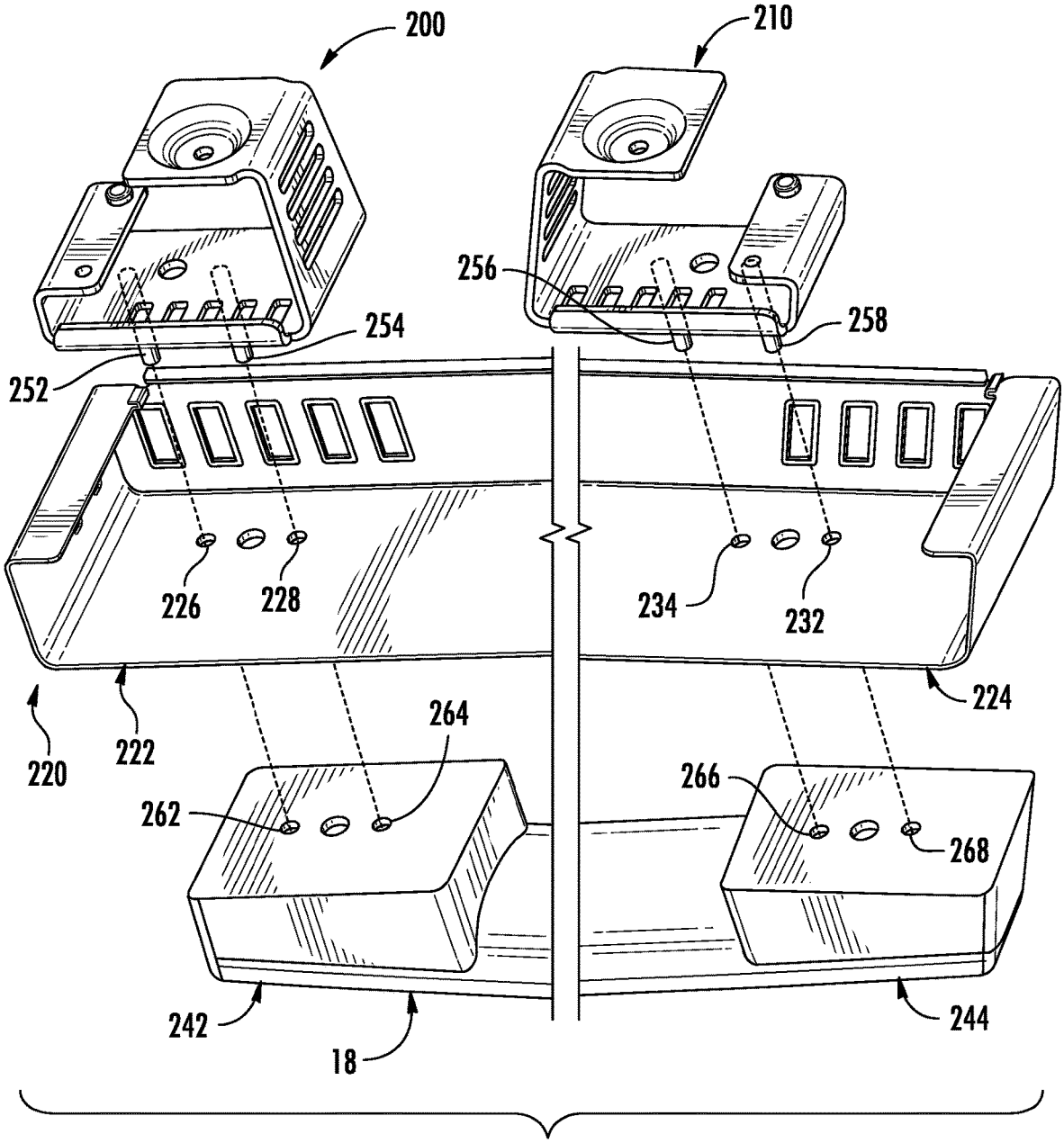
FIG. 7D provides a perspective view of the relationship between a door handle, door trim, and handle bracket according to one or more exemplary embodiments of present disclosure.

FIG. 7D provides still another alternative embodiment. In this embodiment, the first outer locating pin 252 is attached to and extends from the first handle bracket 200, extending through an outer opening 262 of the first end 242 of the door handle 18. The first inner locating pin 254 is attached to and extends from the first handle bracket 200, extending through the inner opening 264 of the first end 242 of the door handle 18. The second inner locating pin 256 is attached to and extends from the second handle bracket 210, extending through an inner opening 266 of the second end 244 of the door handle 18. And the second outer locating pin 258 is attached to and extends from the second handle bracket 210, extending through an outer opening 268 on the second end 244 of the door handle 18.

In the embodiment of FIG. 7D, the extension of the first outer locating pin 252 through the outer opening 262 of the first end 242 of the door handle 18 fixes the horizontal and vertical position of the first handle bracket 200, ensuring consistent location of first handle bracket 200 for alignment with the connecting means through oven door 16. Similarly, the extension of the first inner locating pin 254 through the inner opening 264 of the first end 242 of the door handle 18 fixes the angular position of the first handle bracket 200, providing the ability to ensure that installation of the first handle bracket 200 consistently aligns embossed connection element 208 with the corresponding opening for the connection means through oven door 16.

Furthermore, the extension of the second outer locating pin 258 through the outer opening 268 of the second end 244 of the door handle 18 fixes the horizontal and vertical position of the second handle bracket 210, ensuring consistent location of second handle bracket 210 for alignment with the connecting means through oven door 16. Similarly, the extension of the second inner locating pin 256 through the inner opening 266 of the second end 244 of the door handle 18 fixes the angular position of the second handle bracket 210, providing the ability to ensure that installation of the second handle bracket 210 consistently aligns embossed connection element 208 with the corresponding opening for the connection means through oven door 16.

The skilled artisan will recognize that the present disclosure is not limited to the arrangement of locating pins in the embodiments of FIGS. 7A to 7D. Rather any combination of the four locating pins extending from one or the other of the door handle 18, the first handle bracket 200, or the second handle bracket 200, in accordance with the teachings herein, is intended to fall within the scope of the present disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance comprising:

a cabinet defining a cooking chamber to receive items to be cooked;

a door pivotably attached to the cabinet, wherein the door pivots between an open position and a closed position for selectively accessing the cooking chamber;

a first handle bracket attached directly to the door, the first handle bracket comprising an outer opening and an inner opening;

a second handle bracket attached directly to the door, the second handle bracket comprising an outer opening and an inner opening;

a door trim comprising a first end and second end, the first end of the door trim comprising an outer opening and an inner opening and the second end of the door trim comprising an outer opening and an inner opening; and a door handle comprising a first end and a second end, the first end of the door handle having a first outer locating pin and a first inner locating pin and the second end of the door handle having a second outer locating pin and a second inner locating pin, wherein the first outer locating pin extends through the outer opening of the first end of the door trim and the outer opening of the first handle bracket;

the first inner locating pin extends through the inner opening of the first end of the door trim and the inner opening of the first handle bracket;

the second inner locating pin extends through the inner opening of the second end of the door trim and the inner opening of the second handle bracket; and the second outer locating pin extends through the outer opening of the second end of the door trim and the outer opening of the second handle bracket.

2. The oven appliance of claim 1, wherein the first outer locating pin is spaced apart from the first inner locating pin in the horizontal direction and the second outer locating pin is spaced apart from the second inner locating pin the in the lateral direction.

3. The oven appliance of claim 1, wherein the outer opening of the second end of the door trim is a slot.

4. The oven appliance claim 3, wherein the first outer locating pin extends through the outer opening of the first end of the door trim fixing the horizontal and vertical position of the door trim and the second outer locating pin extends through the outer opening of the second end of the door trim fixing the angular position of the door trim.

5. The oven appliance of claim 1, wherein the inner opening of the first handle bracket and the inner opening of the second handle bracket are slots.

6. The oven appliance of claim 5, wherein the first outer locating pin extends through the outer opening of the first handle bracket fixing the horizontal and vertical position of the first handle bracket and the first inner locating pin extends through the inner opening of the first handle bracket fixing the angular position of the first handle bracket.

7. The oven appliance of claim 5, wherein the second outer locating pin extends through the outer opening of the second handle bracket fixing the horizontal and vertical position of the second handle bracket and the second inner locating pin extends through the inner opening of the second handle bracket fixing the angular position of the second handle bracket.

8. The oven appliance of claim 1, wherein each of the first handle bracket and the second handle bracket further comprises a first plate;

a second plate substantially parallel to the first plate, spaced apart from the first plate in the transverse direction, and situated further from the door handle than the first plate;

a connector plate, the connector plate connecting the first plate to the second plate, and wherein each of the first handle bracket and the second handle bracket are directly connected to the door at the second plate.

9. An oven appliance comprising:

a cabinet defining a cooking chamber to receive items to be cooked;

a door pivotably attached to the cabinet, wherein the door pivots between an open position and a closed position for selectively accessing the cooking chamber;

a first handle bracket attached directly to the door;

a second handle bracket attached directly to the door;

a door trim comprising a first end and second end, the first end of the door trim comprising an outer opening and an inner opening and the second end of the door trim comprising an outer opening and an inner opening; and a door handle comprising a first end and a second end;

a first outer locating pin extending through the outer opening of the first end of the door trim and connecting to the first end of the door handle, the first end of the door trim, and the first handle bracket;

a first inner locating pin extending through the inner opening of the first end of the door trim and connecting to the first end of the door handle, the first end of the door trim, the first handle bracket;

a second inner locating pin extending through the inner opening of the second end of the door trim and connecting to the second end of the door handle, the second end of the door trim, and the second handle bracket; and a second outer locating pin extending through the outer opening of the second end of the door trim and connecting to the second end of the door handle, the second end of the door trim, and the second handle bracket.

10. The oven appliance of claim 9, wherein the first outer locating pin is attached to and extends from the first end of the door handle, extending through an outer opening in first handle bracket;

the first inner locating pin is attached to and extends from the first handle bracket, extending through an inner opening on the first end of the door handle;

the second inner locating pin is attached to and extends from the second handle bracket, extending through an inner opening on the second end of the door handle; and the second outer locating pin is attached to and extends from the second end of the door handle, extending through an outer opening on the second handle bracket.

11. The oven appliance of claim 10, wherein the first outer locating pin extends through the outer opening of the first handle bracket fixing the horizontal and vertical position of the first handle bracket and the first inner locating pin extends through the inner opening of the first end of the door handle fixing the angular position of the first handle bracket.

12. The oven appliance of claim 10, wherein the second outer locating pin extends through the outer opening of the second handle bracket fixing the horizontal and vertical position of the second handle bracket and the second inner locating pin extends through the inner opening of the second end of the door handle fixing the angular position of the second handle bracket.

13. The oven appliance of claim 9, wherein the first outer locating pin is attached to and extends from the first handle bracket, extending through an outer opening in first end of the door handle;

the first inner locating pin is attached to and extends from the first end of the door handle, extending through an inner opening on the first handle bracket;

the second inner locating pin is attached to and extends from the second end of the door handle, extending through an inner opening on the second handle bracket; and the second outer locating pin is attached to and extends from the second handle bracket, extending through an outer opening on the second end of the door handle.

14. The oven appliance of claim 13, wherein the first outer locating pin extends through the outer opening of the first end of the door handle fixing the horizontal and vertical position of the first handle bracket and the first inner locating pin extends through the inner opening of the first handle bracket fixing the angular position of the first handle bracket.

15. The oven appliance of claim 13, wherein the second outer locating pin extends through the outer opening of the second end of the door handle fixing the horizontal and vertical position of the second handle bracket and the second inner locating pin extends through the inner opening of the second handle bracket fixing the angular position of the second handle bracket.

16. The oven appliance of claim 9, wherein the first outer locating pin is attached to and extends from the first handle bracket, extending through an outer opening in first end of the door handle;

the first inner locating pin is attached to and extends from the first handle bracket, extending through an inner opening on the first end of the door handle;

the second inner locating pin is attached to and extends from the second handle bracket, extending through an inner opening on the second end of the door handle; and the second outer locating pin is attached to and extends from the second handle bracket, extending through an outer opening on the second end of the door handle.

17. The oven appliance of claim 16, wherein the first outer locating pin through the outer opening of the first end of the door handle fixes the horizontal and vertical position of the first handle bracket and the first inner locating pin through the inner opening of the first end of the door handle fixes the angular position of the first handle bracket.

18. The oven appliance of claim 16, wherein the second outer locating pin extends through the outer opening of the second end of the door handle fixing the horizontal and vertical position of the second handle bracket and the second inner locating pin extends through the inner opening of the second end of the door handle fixing the angular position of the second handle bracket.

19. The oven appliance of claim 9, wherein the outer opening of the second end of the door trim is a slot.

20. The oven appliance claim 9, wherein the first outer locating pin extends through the outer opening of the first end of the door trim fixing the horizontal and vertical position of the door trim and the second outer locating pin extends through the outer opening of the second end of the door trim fixing the angular position of the door trim.

* * * * *